US005435497A

United States Patent [19]

Romagnoli

[11] Patent Number: 5,435,497

[45] Date of Patent: Jul. 25, 1995

[54] YARN CENTER WITH DIAMETER REDUCTION

[76] Inventor: Fabia Romagnoli, Via Pier della Francesca, No. 8, 50047 Prato, Italy

[21] Appl. No.: 110,404

[22] Filed: Aug. 23, 1993

[30] Foreign Application Priority Data

Aug. 28, 1992 [IT] Italy ..... FI92U102

[51] Int. Cl.[6] ..... B65H 75/20

[52] U.S. Cl. ..... 242/118.110

[58] Field of Search ..... 242/118.1, 118.11, 118.2, 242/604

[56] References Cited

U.S. PATENT DOCUMENTS

| | | | |
|---|---|---|---|
| 2,633,729 | 4/1953 | Slaughter | 242/118.1 X |
| 2,746,280 | 5/1956 | Russell | 242/118.1 X |
| 3,563,491 | 2/1971 | Hahm | 242/118.11 |
| 3,718,287 | 2/1973 | Sottosanti | 242/118.11 |
| 3,756,531 | 9/1973 | Draper | 242/118.11 |
| 3,756,532 | 9/1973 | Draper | 242/118.11 |
| 3,759,461 | 9/1973 | Draper | 242/118.11 |
| 5,255,870 | 10/1993 | Romagnoli | 242/118.1 |

FOREIGN PATENT DOCUMENTS

| | | |
|---|---|---|
| 1414528 | 9/1965 | France . |
| 1520618 | 4/1968 | France . |
| 8404337 | 11/1984 | WIPO . |

*Primary Examiner*—Daniel P. Stodola
*Assistant Examiner*—Michael R. Mansen
*Attorney, Agent, or Firm*—McGlew & Tuttle

[57] ABSTRACT

The center has, on its cylindrical wall, adjacent longitudinal rows of slots (3) which are elongated lengthwise, the slots of one row being staggered—generally by half a pitch—with respect to those of the contiguous rows, so that the longitudinal edges of each slot (3) can be brought closer together in the intermediate zone, allowing a substantially uniform reduction in the transverse section of the center when the cylindrical wall of the center is subjected to centripetal pressure under the action of the turns of the wound yarn; an extension (5) projecting into the slot (3) constitutes a spacing element to limit the amount by which the longitudinal edges are brought closer together in their intermediate zone.

9 Claims, 2 Drawing Sheets

YARN CENTER WITH DIAMETER REDUCTION

DESCRIPTION

FIELD AND BACKGROUND OF THE INVENTION

The invention relates to a center which can be made of injection-molded plastic, which is substantially tubular and cylindrical in shape, designed to receive yarn wound in turns and which is intended to undergo various processing operations and in particular dyeing treatments using liquid dye which is introduced inside the center and which penetrates in a centrifugal direction through the turns of the yarn in order to dye it in the most uniform way possible; the spools of yarn wound on the centers are consequently inserted in suitable dyeing equipment in order to carry out the abovementioned operation. In the case of certain yarns especially, powerful tension develops in the yarn when it is wetted and heated which gives rise to high tightening forces being exerted on the center; for these reasons, it is advantageous for the center to be able to undergo a reduction in its diameter, i.e. in its transverse section, in order to reduce the forces exerted by the yarn and especially to make these forces substantially uniform even deep within the spool, so as to ensure that the mass of yarn wound in turns is dyed in a substantially uniform manner. Centers which allow this reduction in transverse section, i.e. in practical terms a reduction in diameter, are already known but these known centers have certain drawbacks and in particular a considerable reduction in the area through which the dyeing liquid can pass through the pervious walls of the center once it has undergone a reduction in diameter. A further drawback of known centers of this type is that the reduction in diameter often cannot be controlled and can give rise to an excessive undesired contraction which can lead to additional drawbacks.

SUMMARY AND OBJECTS OF THE INVENTION

The center according to the invention not only ensures a reduction in the diameter, i.e. in the transverse section, of the center while maintaining an ample area of passages through the tubular and cylindrical wall of the center even when it is in its reduced-diameter state, but also offers the possibility of being able to control the reduction in diameter, i.e. in the transverse section, of the center down to a minimum value which can be reproducibly controlled. These and other objects and advantages will become evident on reading the text which follows.

Basically the center in question—which is made from injection-moulded plastic and is able to allow a reduction in diameter as a result of the shrinkage of the yarn of the spool formed on the center, consequent upon the treatments to which the yarn is subjected—has, on its cylindrical wall, adjacent longitudinal rows of slots which are elongated lengthwise, the slots of one row being staggered—generally by half a pitch—with respect to those of the contiguous rows; in this way the longitudinal edges of each slot can be brought closer together in the intermediate zone, allowing a substantially uniform reduction in the transverse section of the center when the cylindrical wall of the-center is subjected to centripetal pressure under the action of the turns of the wound yarn.

Advantageously, in an intermediate position along at least one of the longitudinal edges of at least some of the slots, an extension is provided which projects into the slot and constitutes a spacing element to limit the amount by which the longitudinal edges are brought closer together in their intermediate zone, in order to limit the reduction in the transverse section. In a preferred version, both the longitudinal sides of a slot have an extension, the two extensions facing each other; the deformation of the two sides being, therefore, symmetrical. The extensions can be of a lesser thickness than that of the wall in which the slots are formed and they can be recessed with respect to the outer surface of the wall of the center; thereby avoiding any risk of pinching the yarn.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
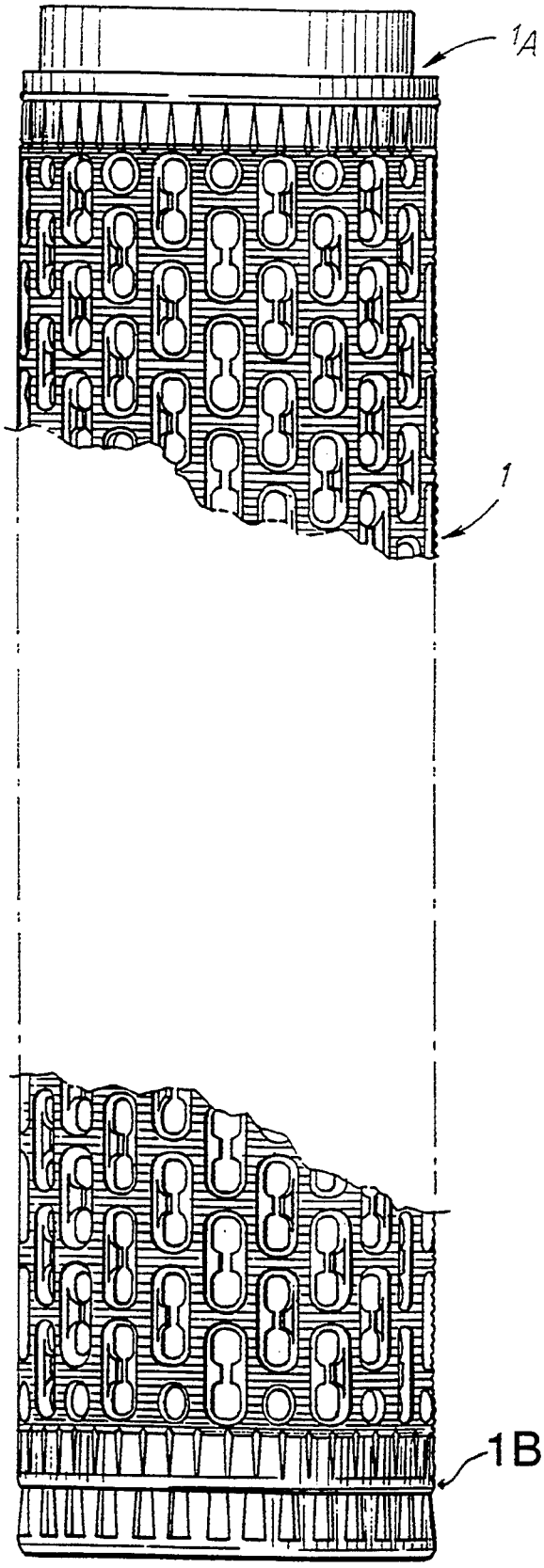
FIGS. 1 and 2 show an outer view of the center respectively before and after it has undergone a contraction in the transverse section under the action of the shrinkage which takes place in the turns of the yarn wound in a spool on it, as a result of dyeing or other treatments.
Figure 4:
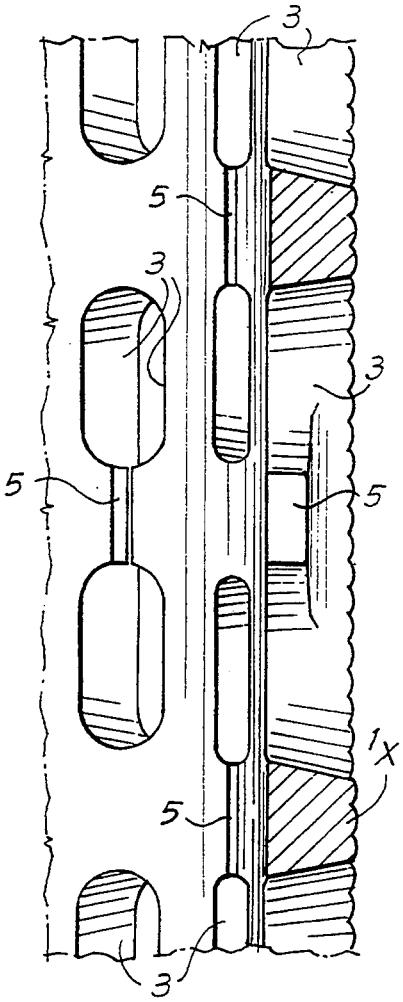
FIG. 4 shows a local section through IV—IV of FIG. 3.

According to the illustration in the appended drawing, in FIG. 1 the reference numeral 1 indicates the center as a whole which has a cylindrical shape with an end 1A shaped in the form of a step and an end 1B which is tapered and has a series of grooves to form a reserve of yarn, in an arrangement which is known per se. The center is shaped with a cylindrical wall which according to the invention has a diameter reduction means which includes adjacent longitudinal rows of slots 3 which are elongated lengthwise; according to the invention, the slots of one row are staggered with respect to those of the adjacent rows. In an intermediate position along the longitudinal sides of the slots 3 extensions 5 are provided, according to the drawing these are double and symmetrical and therefore facing each other, which when the center is new and in its normal state are distanced from one another by an amount D. In practice, the extensions 5 of the slots 3 of a longitudinal row of slots correspond to the distance between contiguous slots of a row of contiguous longitudinal slots. The extensions 5 are recessed with respect to the outer surface of the center, indicated by 1X in FIG. 4; in practice the extensions 5 can be flush with the inner surface of the cylindrical wall of the center.

The center is made in order to form thereon a spool of yarn which is intended to be processed in particular to be dyed. The liquid dye is generally introduced inside a stack of centers, i.e. a stack of spools, and penetrates through the mass of turns of the yarn in order to dye them.

Figure 2:
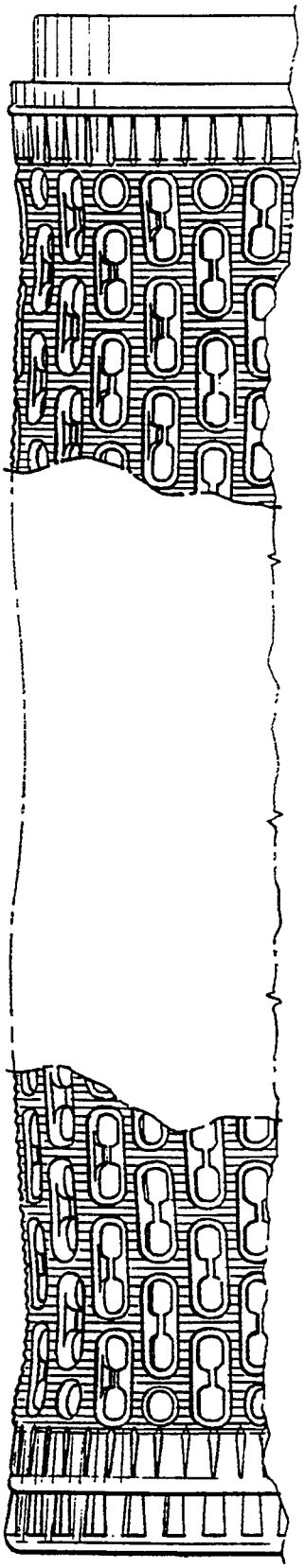
Figure 3:
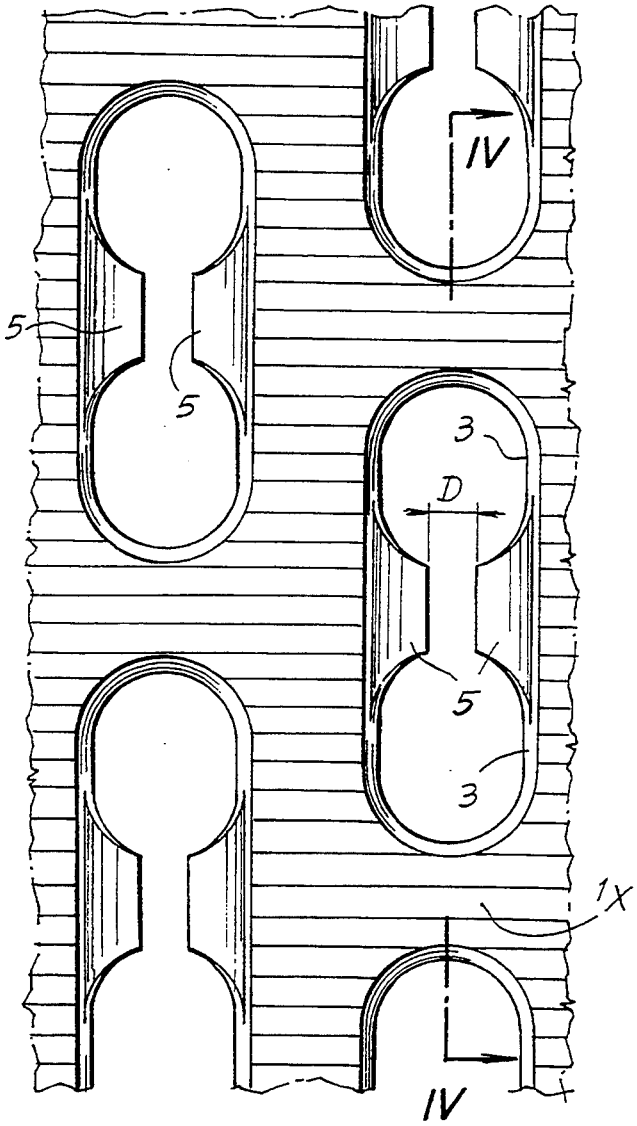
FIG. 3 shows a detail of the surface of the center before the deformation.

In the case of at least certain types of yarn which are to be dyed and which are formed into spools on the center, on moistening they undergo shrinkage, i.e. the yarn shortens, which leads to a centripetal pressure being exerted on the cylindrical wall of the center. In order to avoid excessive stresses on the yarn and to reduce and even out the compression of the turns over the radial thickness of the mass of turns of the yarn wound in a spool on the center, the wall of the center is made with the diameter reduction means so that it can yield centripetally in order to alleviate this pressure which is due to moistening of the yarn on the spool. The arrangement according to the invention allows a reduction in the transverse section of the center as can be clearly seen by comparing FIGS. 1 and 2, FIG. 2 showing the center after deformation as a result of compression by the turns. This compression causes the extensions 5 to be brought closer together thereby reducing the distance D between the facing ends of the extensions 5. Ultimately, the ends of the extensions 5 can be made to touch, in which case the distance D is zero; however, reduction in the cross section is stopped once said distance is zero and this represents the state of maximum reduction in the cross section. The fact that the slots 3 of the contiguous longitudinal rows of slots are staggered allows a reduction in the cross section, together with a slight deformation of the areas of cylindrical wall, which areas are delimited by the elongated slots 3. Even when the elongated slots 3 are reduced, they still retain a relatively very ample area which ensures the flow of the liquid dye from the inside through the mass of the turns towards the outside of the spool.

The extensions 5 are formed inside the outer surface 1X of the center and, therefore., this avoids any risk of the yarn being pinched by the extensions 5 as they are brought closer together; in practice the extensions 5 are narrower than the thickness of the wall of the center and they are generally flush with the inner surface of the cylindrical wall of the center.

The configuration of the invention is such that it also allows for a step such as that 1A, which facilitates alignment and stacking of the successive centers, thereby eliminating the need to place a separating plate between them.

I claim:

1. A yarn center comprising:

a cylindrical wall having a longitudinal axis, said cylindrical wall including diameter reduction means for reducing a diameter of said cylindrical wall when said cylindrical wall is compressed by yarn, said diameter reduction means includes a plurality of slots defined by said cylindrical wall, each of said plurality of slots extending substantially parallel to said longitudinal axis, said plurality of slots being arranged in a plurality of rows, each of said plurality of rows extending substantially parallel to said longitudinal axis, slots of one of said rows being staggered with respect to slots of adjacent rows, said cylindrical wall being yieldable centripetally to move longitudinal sides of said slots closer together and reduce said diameter of said cylindrical wall, said diameter reduction means also includes extensions positioned on said longitudinal sides and extending into said slots to limit a distance between said longitudinal sides of said slots and a reduction of said diameter of said cylindrical wall.

2. A center in accordance with claim 1, wherein:
said extensions are positioned spaced from ends of said slots.

3. A center in accordance with claim 1, wherein:
said extensions are positioned substantially midway between ends of said slots.

4. A center in accordance with claim 1, wherein:
said slots in said rows are spaced apart by a distance substantially equal to a length of said extensions.

5. A center in accordance with claim 1, wherein:
said extensions are longitudinally positioned at a point substantially equal to a longitudinal position of spaces between said slots in said adjacent rows.

6. A center in accordance with claim 1, wherein:
said slots are staggered by substantially half a pitch from said slots in said adjacent rows.

7. A center in accordance with claim 1, wherein:
each longitudinal side of said plurality of slots includes one of said extensions, said extensions of a same slot being positioned substantially opposite each other.

8. A center in accordance with claim 1, wherein:
said extensions having a thickness less than a thickness of said cylindrical wall.

9. A center in accordance with claim 8, wherein:
said extension is recessed with respect to an outer surface of said cylindrical wall.

* * * * *